US005237841A

United States Patent [19]

Lonati et al.

[11] Patent Number: 5,237,841

[45] Date of Patent: Aug. 24, 1993

[54] THREAD FEED UNIT USING PNEUMATIC ACTUATORS

[75] Inventors: Francesco Lonati; Ettore Lonati; Fausto Lonati; Tiberio Lonati, all of Brescia, Italy

[73] Assignee: Lonati S.r.l., Monza, Italy

[21] Appl. No.: 944,656

[22] Filed: Sep. 14, 1992

[30] Foreign Application Priority Data

Sep. 19, 1991 [IT] Italy ..... MI91A002475

[51] Int. Cl.[5] ..... D04B 15/60

[52] U.S. Cl. ..... 66/139; 66/140 R

[58] Field of Search ..... 66/138, 139, 140 R, 66/140 S, 133, 136

[56] References Cited

U.S. PATENT DOCUMENTS

| | | | |
|---|---|---|---|
| 2,885,874 | 5/1959 | Polach | 66/140 |
| 3,500,663 | 3/1970 | Schmidt | 66/139 |
| 3,605,444 | 9/1971 | Lonati | 66/139 X |
| 4,233,826 | 11/1980 | Lonati | 66/140 R |
| 4,385,507 | 5/1983 | Sawazaki | 66/140 R |

FOREIGN PATENT DOCUMENTS

| | | | |
|---|---|---|---|
| 0026425 | 4/1981 | European Pat. Off. . | |
| 0825445 | 11/1951 | Fed. Rep. of Germany . | |
| 3005805 | 8/1981 | Fed. Rep. of Germany | 66/140 R |
| 2380211 | 9/1978 | France . | |
| 1259187 | 1/1972 | United Kingdom . | |
| 2007728 | 5/1979 | United Kingdom . | |

*Primary Examiner*—Clifford D. Crowder
*Assistant Examiner*—John J. Calvert
*Attorney, Agent, or Firm*—Guido Modiano; Albert Josif

[57] ABSTRACT

The thread feed unit has a supporting block which can be associated with a knitting machine laterally to the needle cylinder or cylinders and is provided with at least one thread guide which has a body provided with an elongated configuration associated with a supporting element and slidable along a direction substantially parallel to its longitudinal extension. The supporting element is associated with the supporting block for oscillation about an oscillation axis transverse to the sliding direction of the thread guide body. A first thread guide actuator is provided and controllably acts on the supporting element to oscillate the thread guide about the oscillation axis, and a second actuator controlling the thread guide body to slide it longitudinally with respect to the supporting element. The first actuator and the second actuator are associated with the supporting block and can be actuated independently of one another.

17 Claims, 4 Drawing Sheets

THREAD FEED UNIT USING PNEUMATIC ACTUATORS

BACKGROUND OF THE INVENTION

The present invention relates to a thread feed unit for circular knitting machines, in particular for double-cylinder machines for manufacturing socks and stockings.

Thread feed units in double-cylinder circular knitting machines are known which comprise a plurality of thread guides which are arranged at each feed station of the machine and are actuated by means of an actuation device which acts on said thread guides in order to move them individually, with their thread dispensing end, from a position which is close to the needle cylinders, in order to supply the thread to the needles which knit at the feed being considered, to a position which is spaced from the needle cylinder, in order to prevent the needles from engaging the thread, so as to be able to feed the needles with threads of different materials, counts or colors according to the various production requirements. The threads of the thread guides which are excluded from the knitting are retained by a cutting and clamping unit which is arranged laterally to the needle cylinder, releases the thread when the related thread guide is moved toward the needle cylinder, and cuts and clamps the thread when the related thread guide is spaced from the needle cylinder.

U.S. Pat. No. 4,233,826 granted Nov. 18, 1980 discloses an actuation device for a feed unit, or line-forming unit, for double-cylinder circular knitting machines wherein the movement for the approach or spacing of each thread guide of the line-forming unit is obtained by means of a cam which, by virtue of a lever, pulls or releases a bowden cable which acts on the related thread guide, causing its movement. The cam is actuated, by means of a gearwheel transmission, by a shaft which rotates at a rate which is synchronized with the rotation rate of the needle cylinder. Since the cam must be kept in such a position as to keep the related thread guide close to, or spaced from, the needle cylinders for the entire time required by the knitting, there is a pawl which connects the gearwheel transmission to the rotating shaft only for the time required to make the cam cover an arc of a circle which corresponds to a variation in the portion of its profile which acts, by means of the bowden cable, on the related thread guide.

The pawl is actuated by means of a system of levers which are mutually connected by another bowden cable and are actuated by a chain, or drum, which acts as programming element, since it is provided with protrusions which are arranged according to the knitting to be performed.

Although the actuation device described in the above mentioned patent has substantial advantages with respect to the actuation devices previously in use, subsequent technological progress in the field has pointed out limitations and problems in this device as well.

More particularly, in the continuous attempt to improve the quantity and quality of the production of these machines, in recent years there has been an increasing resort to electronically controlled actuators and accessories arranged around the needle cylinders, or in the region where the feed units are arranged.

Due to this reason, one of the fundamental problems in the design of these units is constituted by the containment of their bulk.

Furthermore, the use of cams with a preset profile for the actuation of the thread guides can constitute a limitation to operating flexibility, which is increasingly required in modern knitting machines.

SUMMARY OF THE INVENTION

The aim of the present invention is to solve the problems described above by providing a feed unit which can have extremely modest overall dimensions with respect to conventional feed units.

Within the scope of this aim, an object of the invention is to provide a feed unit wherein the thread guides can be actuated with the needle cylinder or cylinders in any angular position during its or their rotation.

Another object of the invention is to provide a feed unit which has good precision and reliability even with high machine operating speeds.

A further object of the invention is to provide a feed unit which is particularly suitable to be actuated by an electronic programmable actuation unit.

Yet another object of the invention is to provide a feed unit whose structure is simple to manufacture with modest production costs.

This aim, these objects and others which will become apparent hereinafter are achieved by a thread feed unit for circular knitting machines, in particular for double-cylinder knitting machines for manufacturing socks and stockings, which comprises a supporting block associatable with a knitting machine laterally to the needle cylinder or cylinders and provided with at least one thread guide having a body provided with an elongated configuration which is associated, slidably, along a direction which is substantially parallel to its longitudinal extension, with a supporting element oscillatably associated with said supporting block at an oscillation axis which is transverse to the sliding direction of said thread guide body, controllably activatable actuation means being provided for the movement of said thread guide, by means of the oscillation of said supporting element about said oscillation axis and by means of the sliding of the thread guide body with respect to said supporting element, from an inactive position to an active position, or vice versa, characterized in that said actuation means comprise first actuator means, which act controllably for oscillating said supporting element about said oscillation axis, and second actuator means, which act controllably for sliding said thread guide body longitudinally with respect to said supporting element, said first actuator means and said second actuator means being associated with said supporting block and being actuatable independently of one another.

BRIEF DESCRIPTION OF THE DRAWINGS

Further characteristics and advantages of the invention will become apparent from the description of a preferred but not exclusive embodiment of the feed unit according to the invention, illustrated only by way of non-limitative example in the accompanying drawings, wherein.

DESCRIPTION OF THE PREFERRED EMBODIMENTS

Figure 1:
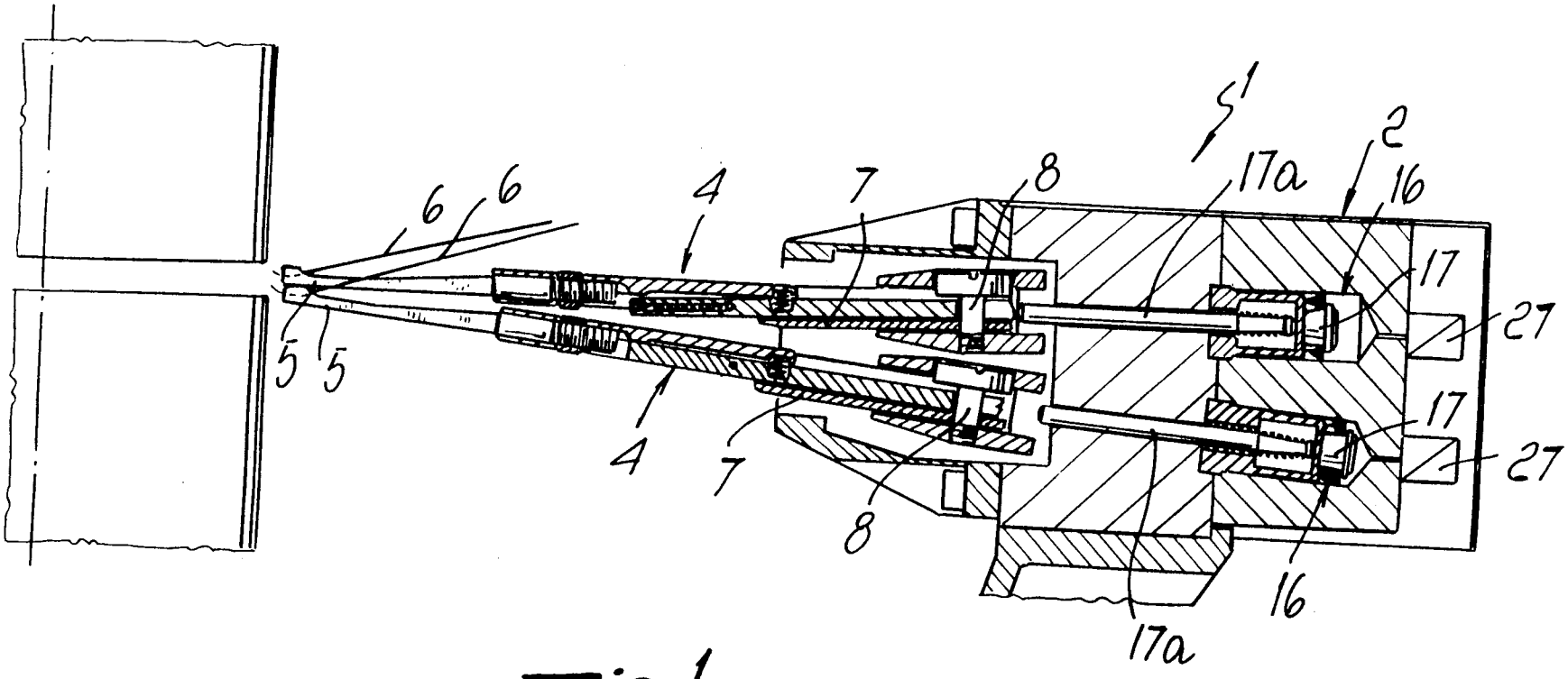
FIG. 1 is a partially sectional view of a feed unit according to the invention, arranged laterally close to the needle cylinders of a double-cylinder circular machine.

With reference to the above figures, the feed unit according to the invention, generally designated by the reference numeral 1, comprises a supporting block 2 which can be associated with the supporting structure of the knitting machine at a feed station, or laterally to the needle cylinder or cylinders 3.

The block 2 can support a plurality of thread guides 4 which can be actuated individually in order to be moved from an inactive position, wherein their end 5 for dispensing the thread 6 is spaced laterally from the needle cylinder so as to prevent the needles from engaging the thread at the feed being considered, to an active position, wherein their end 5 for dispensing the thread 6 is closer to the needle cylinder in order to allow the needles to engage the thread.

More particularly, each thread guide comprises a supporting element 7 which is associated with the block 2 by means of a pivot 8 so that it can oscillate about the axis 8*a* of said pivot which is arranged parallel to the axis 3*a* of the needle cylinders, or is slightly inclined so as to allow the dispensing ends 5 of the various thread guides to converge in the direction of the needle cylinders. Each thread guide furthermore comprises a body 9 provided with an elongated configuration which is mounted on the supporting element 7 transversely to the pivot 8 and can slide with respect to said supporting element 7 along a direction which is parallel to the longitudinal extension of the body of said thread guide.

More particularly, a portion of the thread guide body 9 is coupled to a sliding seat 10 which is defined in the supporting element 7, and said portion of the thread guide body is provided with a slot 11 which is crossed by the pivot 8 and is elongated in a direction which is parallel to the extension of the thread guide body so as to allow it to slide with respect to the supporting element 7.

In practice, the transfer of the thread guide from the inactive position to the active position, or vice versa, occurs by means of an oscillation of the supporting element 7 in a plane which is perpendicular or slightly inclined with respect to the axis 3*a* of the needle cylinders and by means of the sliding of the thread guide body 9 with respect to the supporting element 7 toward or away from the needle cylinder axis 3*a*.

Transfer from the inactive position to the active position, or vice versa, is obtained by virtue of actuation means comprising first actuator means, which controllably act on the supporting element 7 in order to make it oscillate about the axis 8*a*, and second actuator means, which controllably act on the thread guide body 9 in order to make it slide longitudinally with respect to the supporting element 7. The first actuator means and the second actuator means are associated with the supporting block 2 and can be actuated independently of one another.

The oscillation arc of the supporting element 7 about the axis 8*a* is delimited by a pair of abutments 12*a* and 12*b* which are defined laterally, on opposite sides with respect to the thread guide, by the supporting block 2. Said abutments 12*a* and 12*b* can be advantageously constituted by an end of screws 13*a* and 13*b* which are associated with the supporting block 2 so as to allow to adjust the extent of the oscillation arc of the thread guide about the axis 8*a*.

The supporting element 7 has, on the opposite side with respect to the dispensing end 5 of the thread guide, two arms, respectively a first arm 15*a* and a second arm 15*b*, which extend laterally on opposite sides with respect to the oscillation axis 8*a*.

Conveniently, the first actuator means are constituted by a linear actuator, preferably a pneumatic cylinder 16 which acts with the stem 17*a* of its piston 17 on the first arm 15*a* in order to cause oscillation of the supporting element 7 about the axis 8*a* in contrast with the action of first return means 18 which act on the second arm 15*b*.

Said first return means 18 can also be advantageously constituted by a linear actuator, preferably a pneumatic cylinder which acts with the end of the stem 19*a* of its piston 19 on the second arm 15*b*. The size of the pneumatic cylinder 18 is such that the momentum about the axis 8*a* generated by the action of said pneumatic cylinder on the supporting element 7 is smaller than the momentum, about the same axis, generated by the actuation of the pneumatic cylinder 16.

The second actuator means face the end 20 of the thread guide body which is opposite to the dispensing end 5 and are advantageously constituted by a linear actuator, preferably a pneumatic cylinder 21 which acts with the end of the stem 22*a* of its piston 22 on the end 20 with a force which has a component which is parallel to the longitudinal extension of the thread guide body so as to make it slide with respect to the supporting element 7 toward the needle cylinders 3. The action of the pneumatic cylinder 21 is contrasted by second return means which are conveniently constituted by a spring 23 which is interposed between the supporting element 7 and the thread guide body 9.

Advantageously, in order to allow the actuation of the supporting element 7 independently of the actuation of the thread guide body 9, the region of the end 20 with which the stem 22*a* makes contact is shaped substantially like a portion of a cylindrical surface whose axis coincides with the axis 8*a*.

The means for the actuation of the thread guide 4 furthermore comprise third actuator means which act on the supporting element 7 in order to position the thread guide in an intermediate angular position along its arc of oscillation about the axis 8*a*. More particularly, said third actuator means are conveniently constituted by a third adjustable-stroke linear actuator 24 which acts on the second arm 15*b* of the supporting element 7 in order to make it oscillate in the opposite direction with respect to the oscillation caused by the pneumatic cylinder 16. The moment generated by the force of the third actuator 24 on the supporting element 7 about the axis 8*a*, together with the moment about said axis generated by the force exerted on the second arm 15*b* by the stem of the pneumatic cylinder 18, is preferably greater than the moment about said axis 8*a* generated by the pneumatic cylinder 16, so that by actuating the third linear actuator 24 the thread guide oscillates about the axis 8*a* in the opposite direction with respect to the oscillation imparted by the pneumatic cylinder 16 without having to interrupt or adjust the actuation of said pneumatic cylinder 16.

The third linear actuator 24 is preferably constituted by a pneumatic cylinder which acts on the second arm 15*b* with the end of the stem 25*a* of its piston 25. The abutment of the piston 25 in the direction of the thread guide is defined by a threaded cylinder 26 inserted in the body of the pneumatic cylinder. The position of the cylinder 26 is adjustable along a direction which is parallel to the axis of the piston 25.

The pneumatic cylinders 16, 21 and 24 are preferably defined in the body of the block 2 and their actuation is controlled, by means of valves 27, 28 and 29 of a known type, by a programmable control element 30 of the electronic type, for example a programmable microprocessor which supervises the operation of the entire machine according to the requirements of the process.

For the sake of completeness in description, it should be noted that a known thread cutting and clamping unit, generally designated by the reference numeral 31, is provided proximate to the feed station of the machine and cooperates with the thread guide 4 in feeding the thread to the needles of the machine.

Although only one thread guide with the related actuation means has been described for the sake of simplicity, a feed unit according to the invention can have a plurality of thread guides, each with its own actuation means, similarly to what has been described with reference to the thread guide considered.

The operation of the feed unit according to the invention is as follows.

Figure 2:
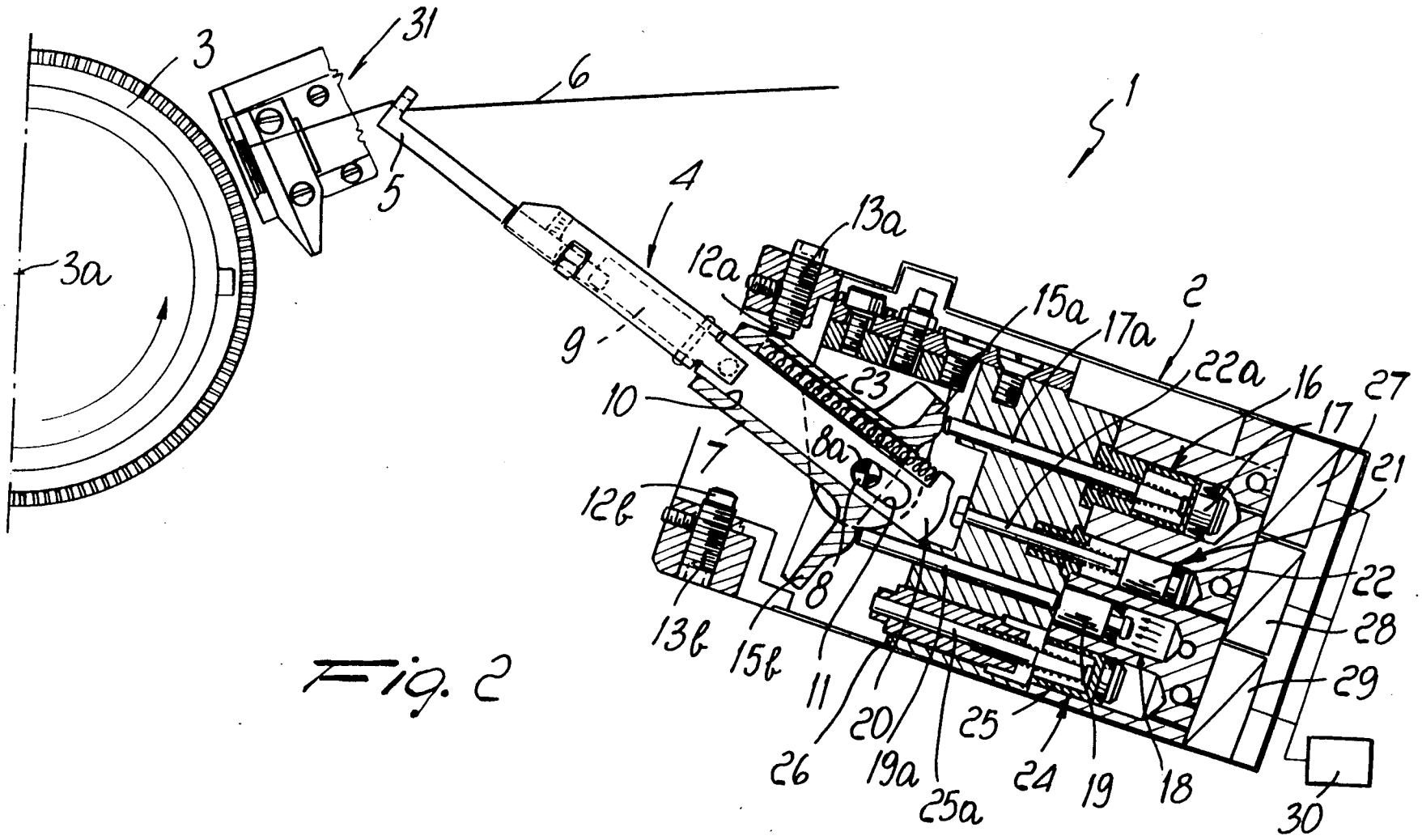
FIG. 2 is a sectional top view of the feed unit, with a thread guide in the inactive position.

When the thread 6 is not to be fed to the needles of the cylinders 3, the thread guide 4 is in the inactive position, as shown in FIG. 2, i.e. with the supporting element 7 rested against the abutment 12*a* and with the dispensing end 5 of the thread guide spaced from the needle cylinders. In this position, the thread guide body 9 is fully retracted on the side opposite to the cylinders 3, and an end of the slot 11 rests against the pivot 8 which acts as stroke limiting abutment. The inactive position of the thread guide is maintained by the pneumatic cylinder 18, which is constantly supplied with pressurized air.

Figures 3, 4:
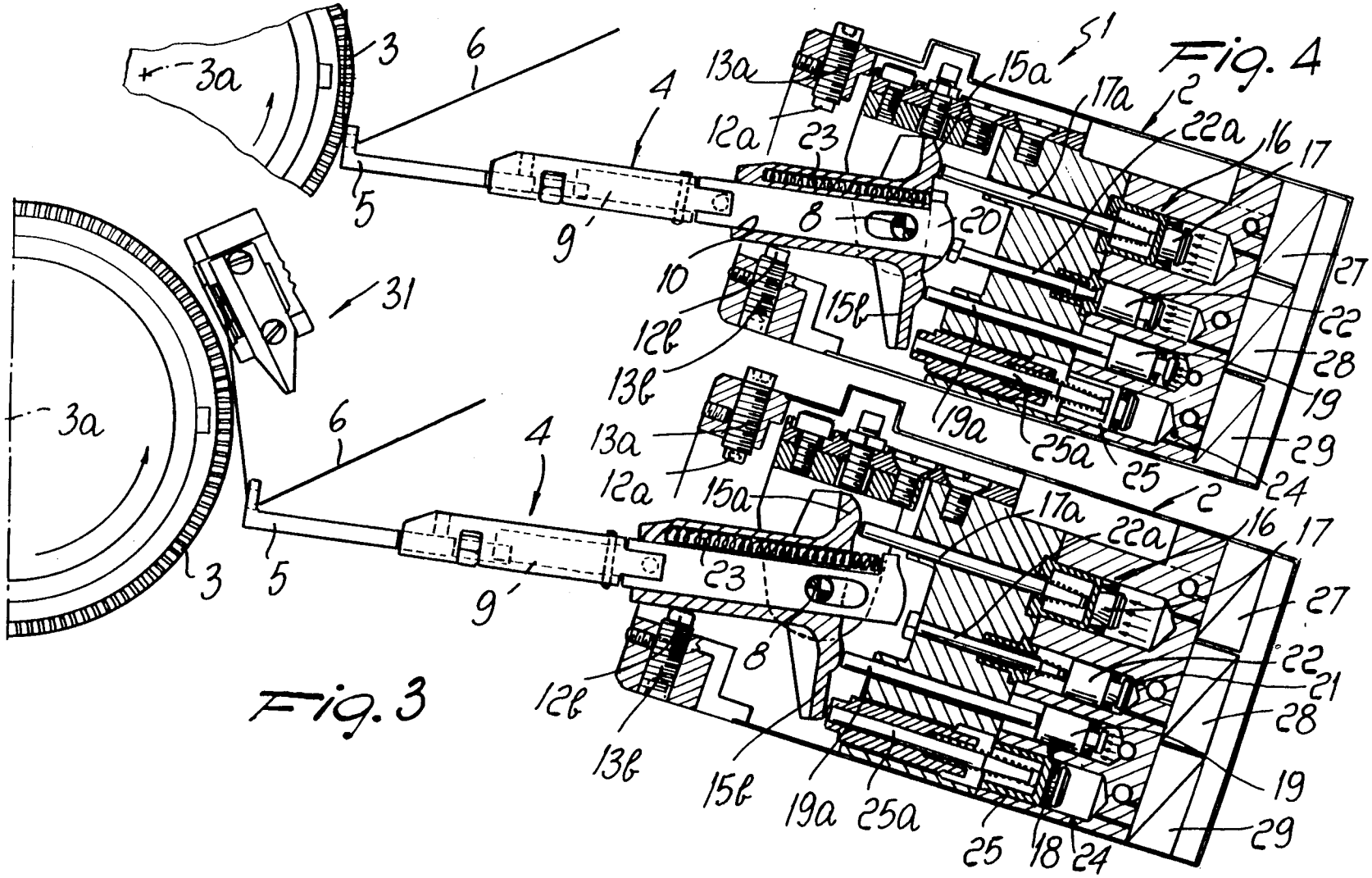
FIGS. 3 and 4 are taken similarly to FIG. 2 and show the transfer of the thread guide from the inactive position to the active position.
Figure 5:
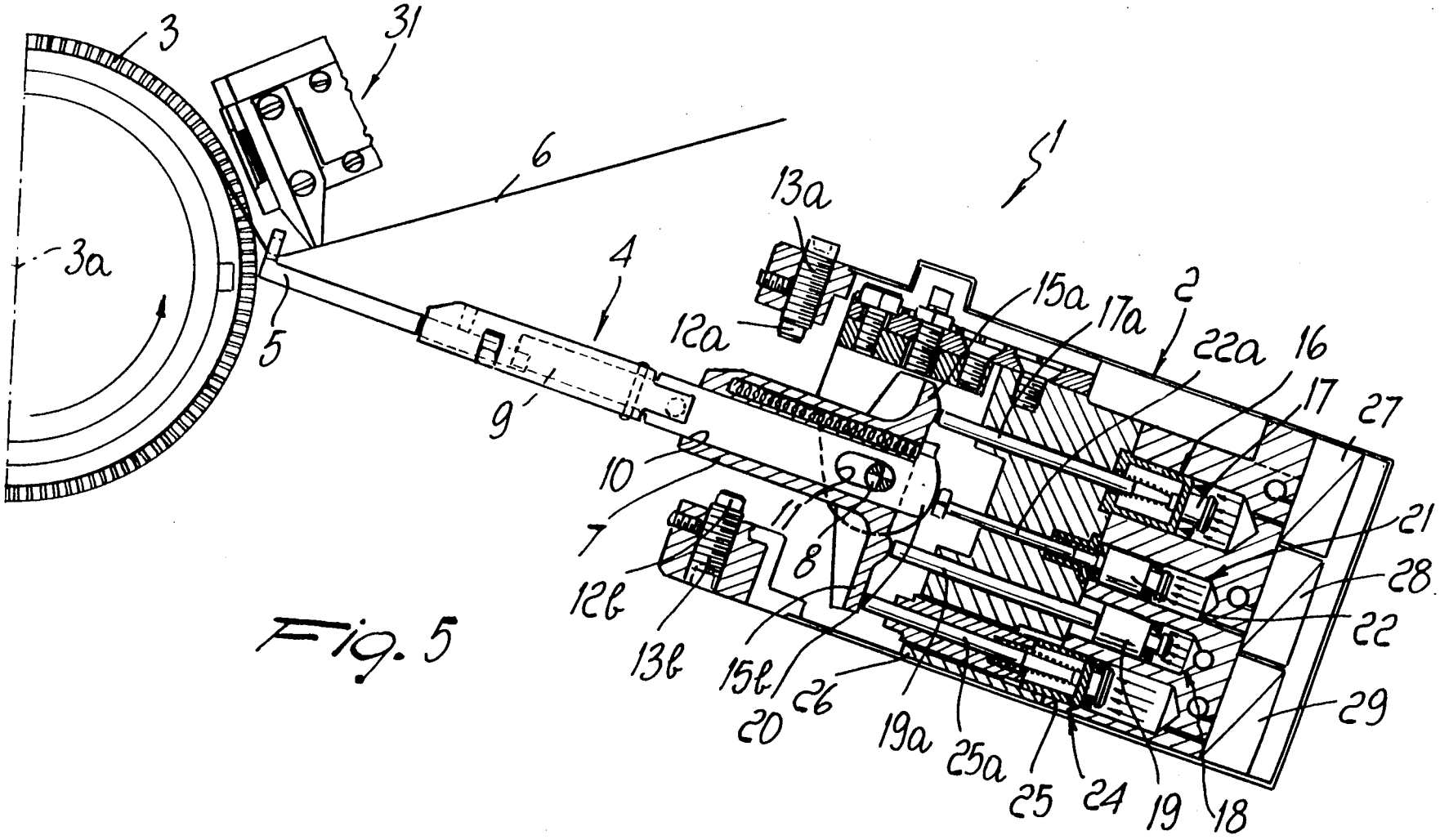
FIG. 5 is similar to FIGS. 2 to 4 and shows a particular arrangement of the thread guide which can be obtained with the feed unit according to the invention.

When the thread 6 is to be fed to the needles of the cylinders 3, the electronic control element 30 acts sequentially on the valves 27 and 28 so as to sequentially actuate the pneumatic cylinder 16 and the pneumatic cylinder 21. The actuation of the pneumatic cylinder 16 causes the actuation of the supporting element 7 about the axis 8*a* until said supporting element is moved against the abutment 12*b*. The subsequent actuation of the pneumatic cylinder 21 makes the thread guide body 9 slide toward the cylinders 3 until the dispensing end 5 is moved to a position suitable to allow the needles to engage the thread (FIGS. 3 and 4).

In the case of particular processes which require the movement of the thread guide 4 to an intermediate position along its oscillation arc, it is possible to provide this positioning by providing, by virtue of the electronic control element 30, the actuation, by means of the valve 29, of the pneumatic cylinder 24 which, as mentioned, causes a partial oscillation of the thread guide 4 in the direction opposite to the oscillation caused by the pneumatic cylinder 16.

The thread guide 4 can be returned from this intermediate position to the active position with the supporting element 7 against the abutment 12*b* simply by deactivating the pneumatic cylinder 24. In order to return the thread guide 4 to its idle position, it is sufficient to deactivate the pneumatic cylinders 21 and 16 in a sequence which is the reverse of the one which has been described.

In practice it has been observed that the feed unit according to the invention fully achieves the intended aim, since by using actuator means which individually cause the oscillation and the sliding of a thread guide toward the needle cylinders, or vice versa, one obtains a great flexibility in actuation which is capable of meeting the most disparate knitting requirements despite a structure which is extremely simple and has a modest bulk.

Furthermore, the use of linear actuators allows to actuate, in an extremely simple manner, the thread guides with a programmable electronic control element.

The feed unit thus conceived is susceptible to numerous modifications and variations, all of which are within the scope of the inventive concept; all the details may furthermore be replaced with technically equivalent elements.

In practice, the materials employed, as well as the dimensions, may be any according to the requirements and the state of the art.

We claim:

1. Thread feed unit for circular knitting machines having single or double cylinders, for manufacturing socks and stockings, comprising a supporting block laterally associated with the needle cylinder or cylinders of the knitting machine and provided with at least one thread guide having a body with an elongated configuration associated slidably along a direction substantially parallel to a longitudinal extension of said body, a supporting element oscillatably associated with said supporting block at an oscillation axis transverse to the sliding direction of the thread guide body, controllably activatable actuation means provided for movement of the thread guide, through the oscillation of said supporting element about said oscillation axis and through the sliding of the thread guide body with respect to said supporting element, from an inactive position to an active position, or vice versa, wherein said actuation means includes first actuator means, for controllably oscillating said supporting element about said oscillation axis, and second actuator means, for controllably sliding said thread guide body longitudinally with respect to said supporting element, said first actuator means and said second actuator means being associated with said supporting block and being actuatable independently of one another.

2. Feed unit, according to claim 1, wherein said supporting block further comprises means for delimiting the oscillation arc of said thread guide about said oscillation axis.

3. Feed unit according to claim 1, wherein said supporting element further comprises two arms extending laterally on opposite sides with respect to said oscillation axis, said first actuator means acting on a first one of said arms contrasting with the action of first return means acting on a second one of said arms.

4. Feed unit according to claim 1, wherein said second actuator means face an end of said thread guide opposite a thread dispensing end.

5. Feed unit according to claim 1, wherein said oscillation axis is arranged substantially parallel to a central axis of the needle cylinder or cylinders.

6. Feed unit according to claim 1, wherein said first actuator means is constituted by a linear actuator for controllable activation and for acting on said first arm of the supporting element.

7. Feed unit according to claim 3, wherein said first return means is constituted by a linear actuator acting on said second arm and for generating a momentum, about said oscillation axis, smaller than the momentum, about the same axis, and can be generated by activating the linear actuator constituting said first actuator means.

8. Feed unit according to claim 1, wherein said second actuator means comprise a linear actuator for controllable activation and for acting on the end of the thread guide body opposite to the thread dispensing end with a force having a component parallel to the longitudinal extension of said thread guide body.

9. Feed unit according to claim 1, further comprising second return means interposed between said thread guide body and said supporting element and elastically contrasting the action of said second actuator means.

10. Feed unit according to claim 8, wherein an end region of the thread guide body with which said second actuator means make contact is shaped like a portion of a cylindrical surface whose axis coincides with said oscillation axis.

11. Feed unit according to claim wherein said actuation means comprise third actuator means acting on said supporting means for positioning said thread guide in an intermediate angular position of an oscillation arc about said oscillation axis.

12. Feed unit according to claim 11, wherein said third actuator means comprise a linear actuator having an adjustable stroke and acting on said second arm in contrast with the action of said first actuator means.

13. Feed unit according to claim 11, wherein the moment about said oscillation axis which is generated by said linear actuator which constitutes said third actuator means, added to the moment generated by said first return means, is greater than the moment, about the same axis, generated by said first actuator means.

14. Feed unit according to claim 1, wherein said supporting element is associated with said supporting block by means of a pivot which defines said oscillation axis, said thread guide body having a portion slidingly coupled in a guiding seat defined in said supporting element, said thread guide body associated with said pivot through a slot, elongated along a direction parallel to the longitudinal extension of the thread guide body.

15. Feed unit according to claim 1, wherein said actuation means are operatively connected to a programmable electronic control element.

16. Feed unit according to claim 8, wherein said linear actuators are constituted by fluid-activated cylinders.

17. Feed unit according to claim 8, wherein said linear actuators comprise fluid-activated cylinders accommodated in said supporting block.

* * * * *